US006857997B2

(12) United States Patent
Yamada et al.

(10) Patent No.: US 6,857,997 B2
(45) Date of Patent: Feb. 22, 2005

(54) BIO CELL CLEANING CENTRIFUGE HAVING BIO CELL CLEANING ROTOR PROVIDED WITH CLEANING LIQUID DISTRIBUTOR

(75) Inventors: Kenji Yamada, Hitachinaka (JP); Kazuhiko Murayama, Hitachinaka (JP); Daijiro Shiraishi, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 160 days.

(21) Appl. No.: 10/386,716

(22) Filed: Mar. 13, 2003

(65) Prior Publication Data

US 2003/0216238 A1 Nov. 20, 2003

(30) Foreign Application Priority Data

May 17, 2002 (JP) ..... P2002-142740
May 17, 2002 (JP) ..... P2002-142781
May 17, 2002 (JP) ..... P2002-143029

(51) Int. Cl.[7] ..... B04B 5/02; B04B 15/12
(52) U.S. Cl. ..... 494/17; 494/20; 494/29
(58) Field of Search ..... 494/16–17, 20–21, 494/23, 27, 29–31, 33, 36, 60; 422/72

(56) References Cited

U.S. PATENT DOCUMENTS 1,644,492 A * 10/1927 Rawolle
2,834,541 A * 5/1958 Szent-Gyorgyi et al.
3,175,732 A * 3/1965 Unger
3,235,173 A * 2/1966 Unger
3,352,486 A * 11/1967 Gibbs
3,401,876 A * 9/1968 Grifols
3,420,437 A * 1/1969 Blum et al.
3,439,871 A * 4/1969 Unger
3,606,142 A * 9/1971 Westberg
3,684,161 A * 8/1972 Unger et al.
3,712,535 A * 1/1973 Genese et al.
3,722,789 A * 3/1973 Kennedy (List continued on next page.)

FOREIGN PATENT DOCUMENTS

| | | | |
|---|---|---|---|
| GB | 1520648 | | 8/1978 |
| GB | 2007546 | A | 5/1979 |
| GB | 2388562 | A * | 11/2004 |
| JP | 50-22693 | | 3/1975 |
| JP | 58-84063 | * | 5/1983 |
| JP | 61-139756 | * | 6/1986 |
| JP | 63-142261 | A | 6/1988 |
| JP | 2-81640 | | 6/1990 |
| JP | 5-301060 | * | 11/1993 |
| WO | WO 98/08611 | A1 | 3/1998 |

OTHER PUBLICATIONS

WPI Abstract Accession No. 1988–203087.

*Primary Examiner*—Charles E. Cooley
(74) *Attorney, Agent, or Firm*—Sughrue Mion, PLLC

(57) ABSTRACT

A bio cell cleaning rotor assembled in a centrifuge. The rotor includes a plurality of test tube holders for holing a plurality of test tubes. The holders are pivotally movably supported to a rotor body so that the test tube holders are moved toward a horizontal direction upon application of centrifugal force. A cleaning liquid distributor is positioned above the rotor and is rotatable together with the rotor for distributing even amount of cleaning liquid to the plurality of test tubes. The distributor includes a disc like upper segment and a disc like lower segment in opposition thereto. The upper and lower distribution segments are molded products and have radially outer side flat sections in intimate contact with each other. A plurality of radial grooves are formed in at least one of the flat sections. The radial grooves serving as cleaning liquid distribution nozzles each having radially outer end open toward each opening of each test tube.

49 Claims, 8 Drawing Sheets

U.S. PATENT DOCUMENTS 3,877,634 A * 4/1975 Rohde et al.
3,951,334 A * 4/1976 Fleming et al.
3,953,172 A * 4/1976 Shapiro et al.
3,981,438 A * 9/1976 Weyant
3,982,691 A * 9/1976 Schlutz
4,190,530 A * 2/1980 Forsythe et al.
4,285,463 A * 8/1981 Intengan
4,431,423 A * 2/1984 Weyant, Jr.
4,449,964 A * 5/1984 Westberg et al.
5,045,047 A * 9/1991 Hutchins et al.

* cited by examiner

BIO CELL CLEANING CENTRIFUGE HAVING BIO CELL CLEANING ROTOR PROVIDED WITH CLEANING LIQUID DISTRIBUTOR

BACKGROUND OF THE INVENTION

The present invention relates to a bio cell cleaning centrifuge, a bio cell cleaning rotor assembled in the centrifuge, and a cleaning liquid distributor assembled in the rotor.

A bio cell cleaning centrifuge is adapted for cleaning bio cell such as red blood cell by separating bio cell from remaining materials while applying a centrifugal force and by cleaning the separated bio cell with a cleaning liquid.

Conventionally, red blood cell are cleaned with a cleaning liquid such as physiological saline so as to remove unwanted antibody from a suspension for antiglobulin test in blood transfusion, cross-matching test, and screening irregular antibody. To this effect, various types of bio cell cleaning centrifuges have been proposed.

For example, laid open Japanese Patent Application Publication No.Sho-50-22693 discloses a cleaning liquid distributor for supplying cleaning liquid to a plurality of test tubes held by a plurality of test tube holders. The distributor includes a conical container and nozzles projecting radially outwardly from a bottom of the conical container. A cleaning liquid is supplied into the conical container at a central portion thereof. The nozzles are made from metal tubes embedded into the container. By the rotation of the conical container, the cleaning liquid supplied therein are ejected radially outwardly from the respective nozzles into associated test tubes.

Laid open Japanese Utility Model Application Publication No. Hei-2-81640 discloses a cleaning liquid distributor in which a distributor body is formed with a plurality of radial drilled holes. Cleaning liquid is ejected out of the drilled holes into a plurality of test tubes held by a plurality of test tube holders.

In order to perform an automatic cleaning to the bio-cell with the centrifuge for executing a desirable blood transfusion check-up, amount of cleaning liquid distributed from a cleaning liquid distributor into the respective test tubes must be equal to one another. If the supplied amount of the cleaning liquid in one test tube is smaller than the amount in the remaining test tubes, greater amount of foreign objects such as antibodies may remain in a suspension in the one test tube. On the other hand, if the supplied amount of the cleaning liquid in one test tube is greater than the amount in the remaining test tubes, amount of the residual foreign objects in the one test tube is smaller than that in the remaining test tubes. This difference in residual amount of the foreign objects may vary or affect the results of test subsequently performed by way of reagent reaction. Accordingly, precise judgment in blood transfusion test may not be achievable.

If re-supply of the cleaning liquid is performed to the specific test tube in which the cleaning liquid had not been sufficiently supplied, remaining test tubes are also subjected to re-supply of the cleaning liquid. Therefore, excessive amount of the cleaning liquid is supplied to the remaining test tubes to cause overflow of the cleaning liquid, thereby loosing precious bio-cells. If cleaning frequencies are determined based on the least amount of the cleaning liquid, cleaning process requires a prolonged period of time.

Unevenness in amount of cleaning liquid supplied into the respective test tubes occurs by several reasons. First reason resides in unevenness in flow resistance in respective fluid passages of the cleaning liquid distributor. For example, in case of the fluid passages provided by the drilled holes as disclosed in the Laid open Japanese Utility Model Application Publication No. Hei-2-81640, shape of a hole inlet, a hole outlet and surface roughness of an inner peripheral surface of the hole may be varied due to drilling. This dimensional inaccuracy leads to unevenness of flow resistance, to thus lead to variation in supplying amount to the respective test tubes. Further, in case of the cleaning liquid distributor disclosed in Laid open Japanese Utility Model Application Publication No. Hei-2-81640, an end face of the metal pipe must be subjected to machining, and length of the metal pipes may be different from one another. This leads to uneven flow resistance to thus lead to variation in supplying amount to the respective test tubes.

The second reason for providing the unevenness in amount of cleaning liquid in the test tubes resides in the leakage of the cleaning liquid from the test tubes. For example, if a distance between the cleaning liquid outlet and an open end of the test tube is too long, cleaning liquid ejected out of the outlet cannot reach the open end due to dimensional error in cleaning liquid electing direction. On the other hand, if the open ends of the test tubes are positioned excessively close to outlet ends of the metal pipes in an attempt to obtain complete entry of the cleaning liquid into the test tube, openings of the test tubes may abut the outlet ends of the metal pipes due to dimensional variation of the test tubes and horizontal rattling of the test tube holders at an initial rotational phase. This may cause breakage of the test tubes.

The third reason for providing the unevenness in amount of cleaning liquid in the test tubes resides in foreign objects contained in the cleaning liquid. Fluffy dust floating in an atmosphere may be involved in the cleaning liquid during its transportation from a pump to the cleaning liquid distributor. If such foreign objects are deposited at the pipes or holes of the distributor, the liquid passages may be blocked to reduce the supplying amount to the test tubes. If physiological saline is used as the cleaning liquid, a solid material such as a precipitated sodium chloride may block the liquid passage in the tank and the distributor to lower the flow rate of the cleaning liquid. In the conventional device, such clogging is invisible from outside. Therefore, cleaning process must be periodically stopped in order to observe the distributed amount of the cleaning liquid in the test tubes. Further, in the conventional device, cleaning liquid is always ejected out of the existing nozzles or holes regardless of the numbers of the test tubes. If numbers of the test tubes is smaller than the numbers of the test tube holders, cleaning liquid is wasted.

SUMMARY OF THE INVENTION

It is therefore, an object of the present invention to overcome the above described drawbacks and deficiencies, and to provide an improved cleaning liquid distributor assembled in a bio cell cleaning rotor of a bio cell cleaning centrifuge, the distributor being capable of distributing even amount of cleaning liquid with respect to a plurality of test tubes.

Another object of the present invention is to provide such bio cell cleaning centrifuge and a bio cell cleaning rotor assembled in the centrifuge provided with the distributor capable of enhancing bio cell cleaning efficiency, while avoiding waste of cleaning liquid.

These and other objects of the present invention will be attained by providing a cleaning liquid distributor for use in a bio cell cleaning rotor, including an upper distribution segment and a lower distribution segment. The upper distribution segment has a disc like shape and has a first radially inner portion formed with a cleaning liquid inlet hole and a first radially outer portion formed into a first flat surface. The lower distribution segment has a disc like shape and is provided in opposition to the upper distribution segment. The lower distribution segment has a second radially inner portion in opposition to the first radially inner portion for forming a space therebetween and a second radially outer portion formed into a second flat surface in intimate contact with the first flat surface. At least one of the first flat surface and the second flat surfaces is formed with a plurality of grooves serving as cleaning liquid distribution nozzles each having a radially inner end in communication with the space and a radially outer end open to an atmosphere.

In another aspect of the invention, there is provided a bio cell cleaning rotor for cleaning bio cells in test tubes with a cleaning liquid, including a rotor body rotatable about its axis, a plurality of test tube holders, and the cleaning liquid distributor. The plurality of test tube holders are pivotally movably supported to the rotor body. The test tubes held by the test tube holders are pivotally movable toward a horizontal direction upon application of centrifugal force thereto. The cleaning liquid distributor is disposed above the rotor body and is rotatable together with the rotor body.

In still another aspect of the invention, there is provided a centrifuge for separating a first material from a second material in test tubes, removing the second material from the test tubes while applying a fluid into the test tubes. The centrifuge includes a main body, a drive mechanism, the rotor, a fluid distributor, and a fluid supplying mechanism. The drive mechanism is supported on the main body and defines a rotation axis. The rotor is coupled to the drive mechanism and is rotationally driven about the rotation axis by the drive mechanism. The fluid distributor is disposed above the rotor body and is rotatable together with the rotor body. The fluid distributor includes an upper distribution segment having a disc like shape and having a first radially inner portion formed with a fluid inlet hole and a first radially outer portion formed into a first flat surface, and a lower distribution segment having a disc like shape and provided in opposition to the upper distribution segment. The lower distribution segment has a second radially inner portion in opposition to the first radially inner portion for forming a space therebetween and a second radially outer portion formed into a second flat surface in intimate contact with the first flat surface. At least one of the first flat surface and the second flat surfaces is formed with a plurality of grooves serving as fluid distribution nozzles each having a radially inner end in communication with the space and a radially outer end open to an atmosphere. The fluid supplying mechanism is provided to the main body for supplying a fluid to the fluid inlet hole of the upper distribution segment. If the fluid is a cleaning liquid, the centrifuge functions as a bio cell cleaning centrifuge.

DETAILED DESCRIPTION OF THE PREFERRED EMBODIMENTS

A bio cell cleaning centrifuge having a bio cell cleaning rotor provided with a cleaning liquid distributor according to a first embodiment of the present invention will be described with reference to FIGS. 1 through 6.

Figure 1:
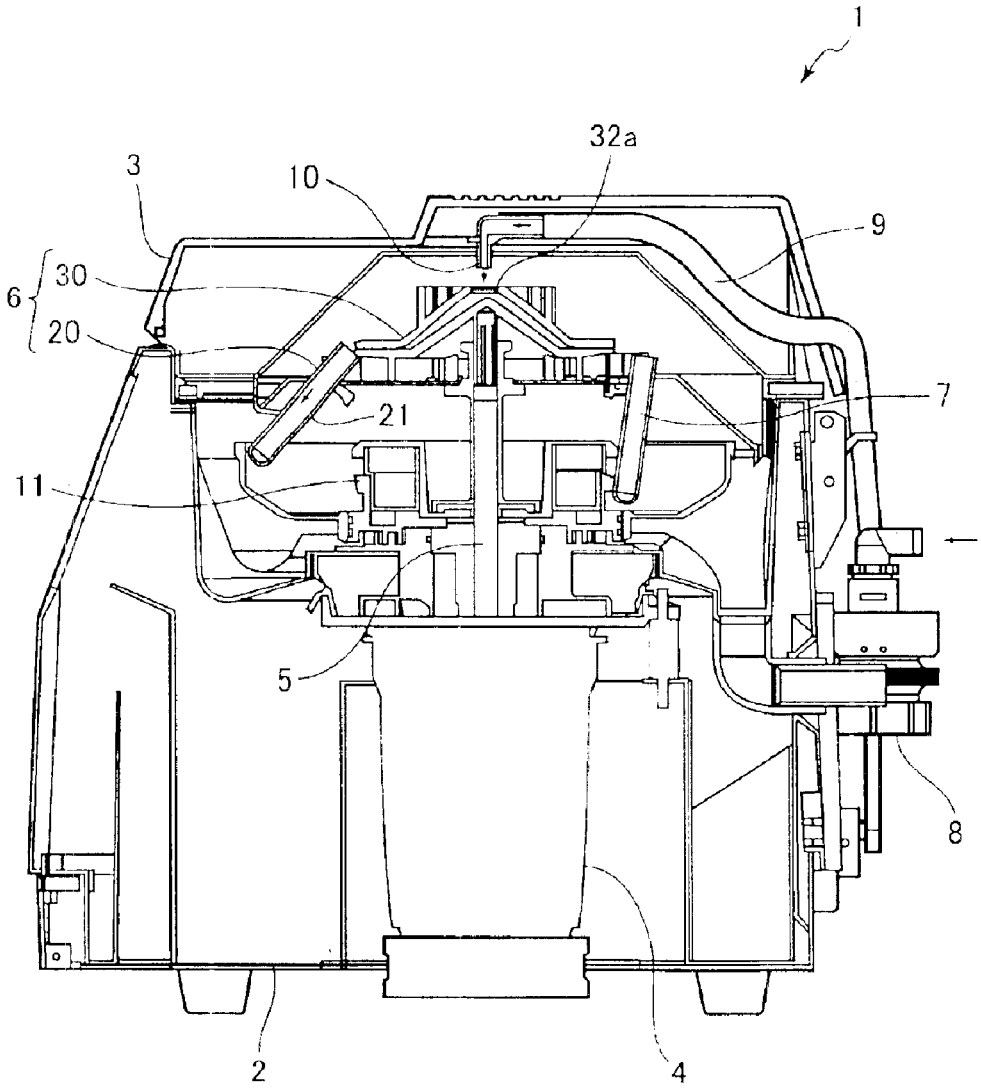
FIG. 1 is a schematic cross-sectional view showing a bio cell cleaning centrifuge according to a first embodiment of the present invention.

As shown in FIG. 1, a bio cell cleaning centrifuge 1 includes a main body 2 and an upper lid 3 for covering an open end of the main body 2. In the main body 2, a drive motor 4 having a drive shaft 5 is installed. The drive motor 4 is driven upon application of a drive voltage by way of a drive circuit (not shown). A bio cell cleaning rotor 6 is attached to the drive shaft 5 and is positioned near the upper open end of the main body 2, so that the bio cell cleaning rotor 6 is rotatable together with the rotation of the drive shaft 5.

The bio cell cleaning rotor 6 includes a main rotor 20 and a cleaning liquid distributor 30 coaxially disposed above the main rotor 20. The main rotor 20 is provided with a plurality of test tube holders 21 each for holding each test tube 7 in which a suitable amount of bio cell such as red blood cell is accumutable. The plurality of test tube holders 21 is a magnetically attracted member made from SUS430. The test tube holders 21 permit the test tubes 7 to be oriented toward a horizontal direction in accordance with a centrifugal force upon rotation of the main rotor 20.

A pump 8 is provided at an outside of and a side wall of the main body 2. The pump 8 is connected to a cleaning liquid tank (not shown). A hose 9 is connected to the pump 8 for directing the cleaning liquid toward the cleaning liquid distributor 30. At the lid 3, a nozzle 10 is provided which is connected to the hose 9. The nozzle 10 is directed at a rotational center portion of the cleaning liquid distributor 30. The cleaning liquid distributor 30 is rotatable together with the rotation of the main rotor 20, and is adapted for distributing cleaning liquid supplied from the nozzle 10 equally into each test tube 7 held by the test tube holders 21 for cleaning bio cell in each test tube 8 during rotation of the main rotor 20.

The main rotor 20 includes a test piece holder attraction member 11 made from an electrically magnetic body. The test piece holder attraction member 11 is adapted for selectively attracting the test piece holder 21 in order to main approximately vertical orientation of the test piece 7 during rotation of the bio cell cleaning rotor 6 at a low speed for centrifugally discharging cleaning liquid radially outwardly from the test tube 7.

Figure 2:
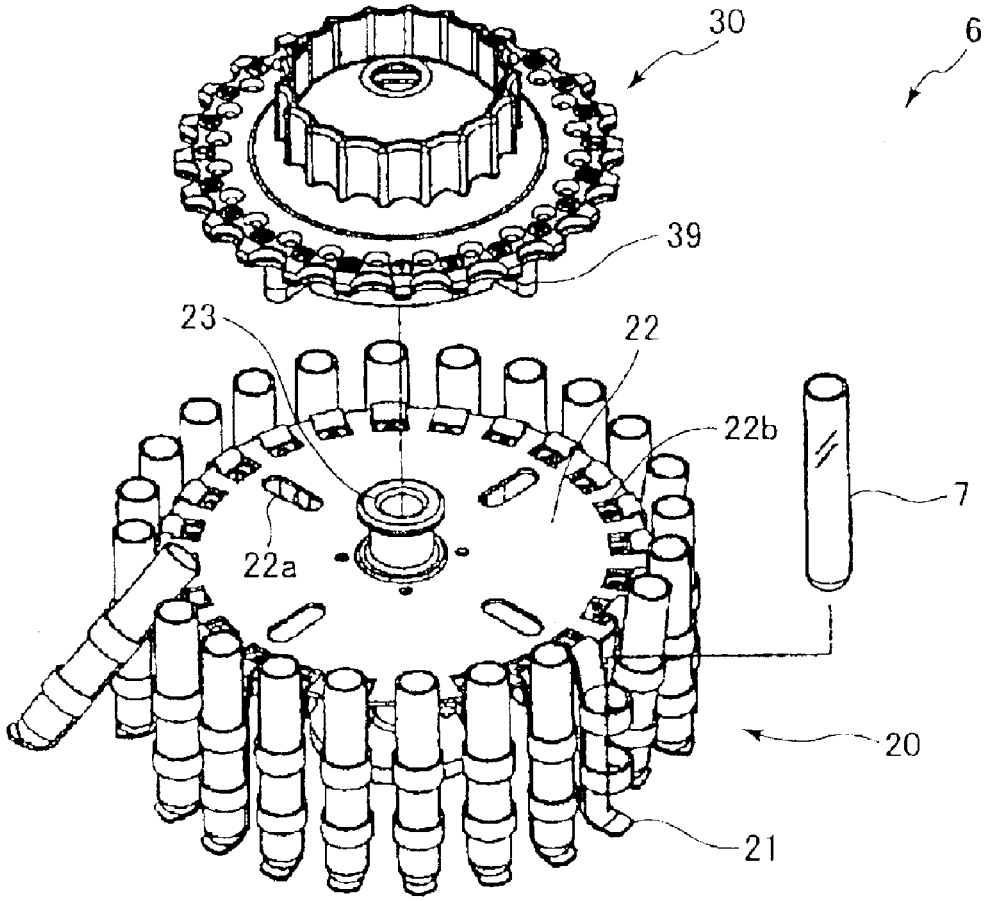
FIG. 2 is an exploded perspective view showing a bio cell cleaning rotor including a main rotor and a cleaning liquid distributor assembled in the centrifuge according to the first embodiment.

FIG. 2 shows a detail arrangement of the bio cell cleaning rotor 6 including the main rotor 20 and the cleaning liquid distributor 30. The main rotor 20 has a disc portion 22 and a central sleeve 23 engageable with the drive shaft 5. The disc portion 22 is formed with a radially extending slots 22*a* positioned at a constant angular interval. Further, at an outer circumferential end portion of the disc portion 22, a plurality of (24 in the depicted embodiment) rectangular holes 22*b* are provided. Each test tube holder 21 is pivotally supported to each rectangular hole 22*b*, so that each test tube holder 21 can be pivotally moved about each rectangular hole 22*b*. The disc portion 22 and the sleeve 23 are made by pressing a stainless steel plate. Alternatively, these can be formed by molding a resin.

Figure 3:
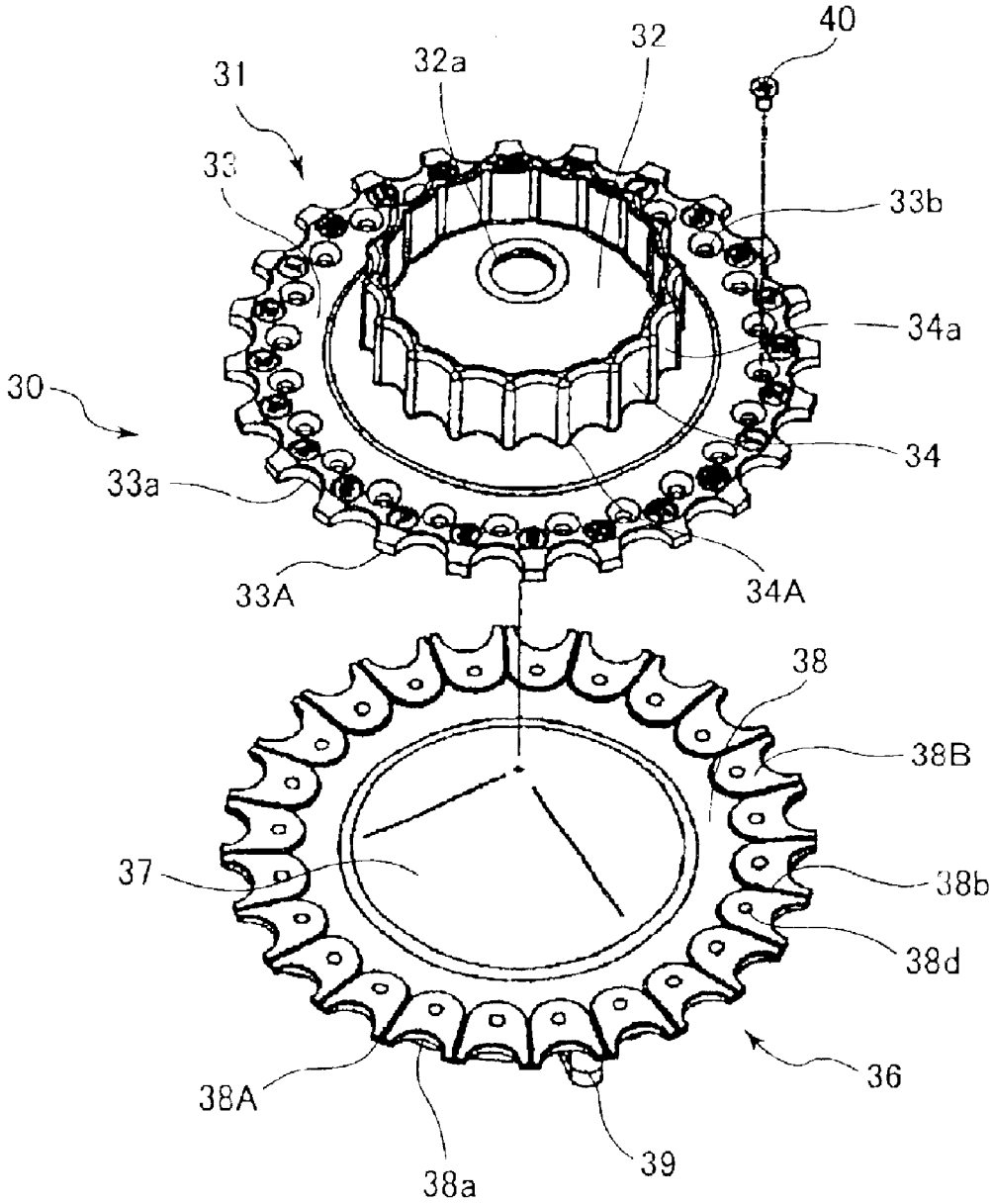
FIG. 3 is an exploded perspective view showing components of the cleaning liquid distributor according to the first embodiment.
Figure 4:
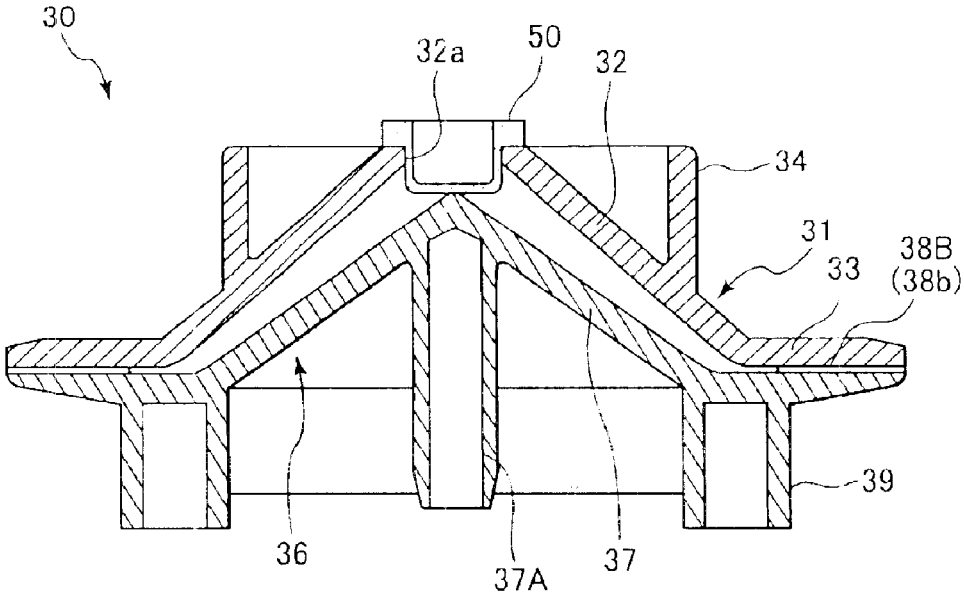
FIG. 4 is a cross-sectional view showing the cleaning liquid distributor according to the first embodiment.
Figure 5:
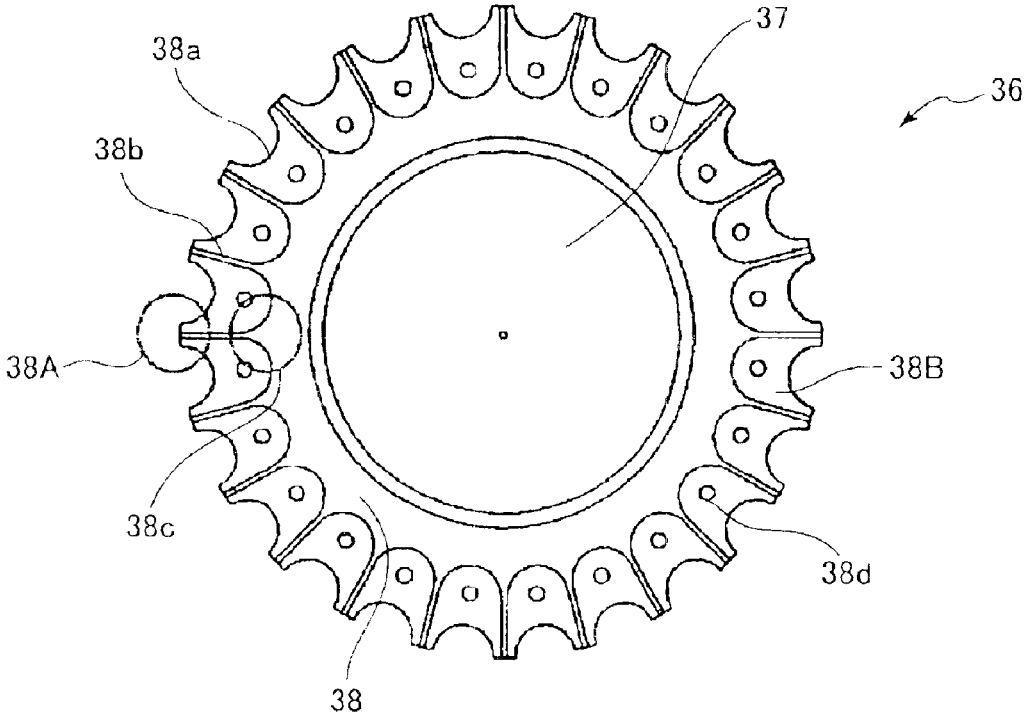
FIG. 5 is a plan view showing a lower distribution segment of the cleaning liquid distributor according to the first embodiment.

As shown in FIG. 2, the cleaning liquid distributor 30 is positioned above the main rotor 20 in concentrical fashion therewith. The cleaning liquid distributor 30 is detachably connected to the main rotor 20 by the engagement of protrusions 39 described later with the radial slots 22*a*. As shown in FIGS. 3 and 4, the cleaning liquid distributor 30 includes an upper distribution segment 31 and a lower distribution segment 36. The upper distribution segment 31 includes a central conical section 32, a radially outer side flat section 33 and a knob section 34. The central conical section 32 is formed with a cleaning liquid inlet hole 32*a* in alignment with the nozzle 10 for introducing the cleaning liquid inside of the conical section 32. A porous filter 50 is detachably mounted into the cleaning liquid inlet hole 32*a* as shown in FIG. 4. The porous filter 50 is adapted for trapping foreign materials contained in the cleaning liquid so that a purified cleaning liquid can be introduced into the conical section 32. The filter 50 is made from a polypropylene resin sintered molded capable of providing a filter pore size of 50 μm. Alternatively, the filter 50 can be formed by screen mesh formed from a stainless steel. The filter 50 can be positioned at the hole 32*a* from the above position of the upper distribution segment 31, so that the filter 50 can be easily replaced by a new filter.

The radially outer side flat section 33 has 24 protrusions 33A, and each arcuate recess 33*a* is defined between neighboring protrusions 33A. Further, screw holes 33*b* are formed in the radially outer side flat section 33 for theadingly engaging with screws 40. Each protrusion 33A has a lower face facing the lower distribution segment 36 and defining a part of a cleaning liquid distribution nozzles. In this connection, the screw holes 33*b* are positioned offset from the protrusions 33A in a radial direction, so that the screws 40 do not interfere a flow of cleaning liquid.

The knob section 34 protrudes from the conical section 32 and is adapted for manually rotating the cleaning liquid distributor 30 and the main rotor 20 after cleaning process. The knob section 34 includes plurality of ribs 34A and a plurality of recesses 34*a* each defined by the neighboring ribs 34A. These ribs 34A and recesses 34*a* are advantageous for facilitating manipulation to the knob 34 without any slippage of fingers with respect to an outer peripheral surface of the knob 34. The upper distribution segment 31 is formed integrally with a transparent resin or translucent resin by molding.

The lower distribution segment 36 is disposed concentrically below the upper distribution segment 31 for defining cleaning liquid distribution nozzles in cooperation therewith. The lower distribution segment 36 includes a central conical section 37 in alignment with the conical section 32 of the upper distribution segment 31 and a radially outer side flat section 38 in alignment with the radially outer flat section 33. A sleeve 37A projects downwardly from the central conical section 37 for engagement with the central sleeve 23 of the main rotor 20. The radially outer side flat section 38 has a plurality of radial projections 38A in alignment with the radial projections 33A for defining an arcuate recess 38*a* between neighboring projections 38A and 38A. Further, the engagement protrusions 39 downwardly protrude from the flat section 38 for engagement with the radial slots 22*a*.

The radially outer side flat section 38 is formed with a plurality of (24 in the embodiment) radial grooves 38*b* at an upper face in confrontation with the upper distribution segment 31 and on the radial projections 38A. In other words, a plurality of protrusions 38B are provided at the radially outer side flat section 38 and are arrayed in a circumferential direction thereof defining the radial groove 38*b* between neighboring protrusions 38B and 38B. Thus, a plurality of radial distribution nozzles are defined by the upper outer side flat section 33 and the radial grooves 38*b* of the lower outer side flat sections 38 in intimate contact with the upper outer side flat section 33.

Each radially inner end portion of each protrusion 38B has a semi-circular shape so as to provide a smooth curvature at an inlet side 38*c* of each groove 38*b* when the cleaning liquid flows from a space defined between the upper and lower conical sections 32 and 37 into the grooves 38*b*. This semi-circular arrangement can reduce variation in flow resistance of the cleaning liquid when the liquid is entered through the inlet side 38*c* into the groove 38*b*. Each protrusion 38B is formed with a female thread hole 38*d* in alignment with each thread hole 33*b* for threading engagement with the screw 40. The lower distribution segment 35 is formed by molding with a resin material.

As shown in FIG. 1, when the bio cell cleaning rotor 6 is rotated, each open end of each test tubes 7 held by each test tube holder 21 is positioned close to each radially outermost end of each radial projection 38A as a result of inclination of the test tube 7 because of application of centrifugal force thereto. Therefore, cleaning liquid can be delivered to each test tube 7 through each groove 38*b*.

Figure 6:
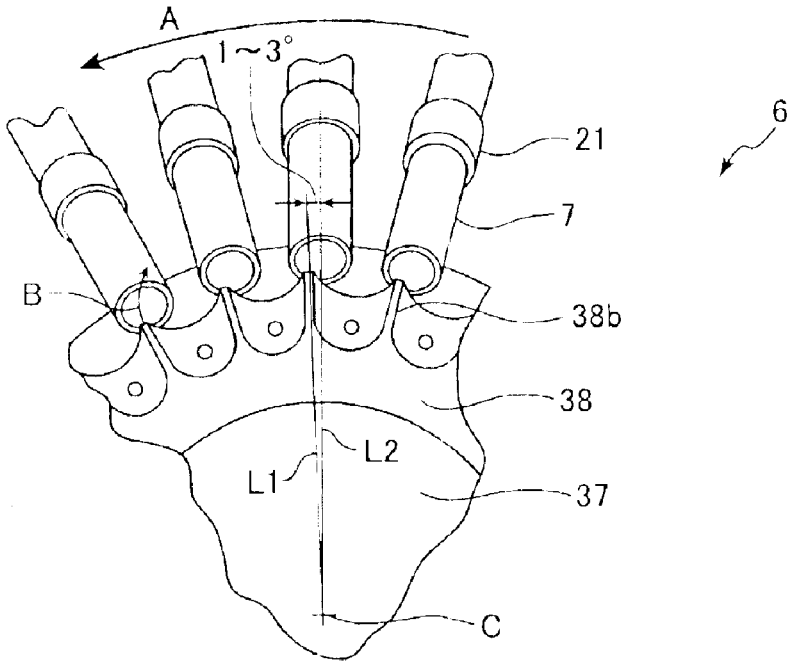
FIG. 6 is a plan view showing a part of the bio cell cleaning rotor, and particularly showing orientation of test tubes and grooves (cleaning liquid injection nozzles) according to the first embodiment.

Further, as shown in FIG. 6, each groove 38*b* are oriented toward a rotational center C of the bio cell cleaning rotor 6 along a line L1, and each test tube holder 21 are oriented so that the test tube 7 held by each test tube holder 21 can be oriented toward the rotational center C along line L2 when centrifugal force is generated by the rotation of the bio cell cleaning rotor 6. Here, the test tube holders 21 are positioned such that each axis (L2) of the test tube holder 21 is not aligned with each center axis (L1) of each groove 38*b*, but these are offset from each other by 0.5 to 5 degrees, and preferably, by 1 to 3 degrees. Further, the line L1 is positioned forwardly of the line L2 in the rotational direction of the rotor 6. To be more specific, if rotation speed of the drive motor 4 is increased in order to reduce processing period of the bio-cell cleaning centrifuge 1, the moving loci of cleaning liquid ejecting out of the cleaning liquid distributor 30 may be curved or deviated as indicated by an arrow B due to increase in wind pressure. Therefore, if the central axis of the test tube 21 is aligned with the groove 38*b*, the deviating cleaning liquid cannot be accurately entered into the test tube 7. To avoid this problem, the above described offsetting arrangement is provided, so that the open end of each test tube 7 is positioned rearwardly of the ejection end of the groove 38*b* in a rotational direction A of the rotor 6. As a result, a desired amount of cleaning liquid can be precisely injected into the test tube 7 even against the deviating flying loci of the cleaning liquid ejected out of the grooves 38*b*.

In operation, 24 test tubes 7 are held by the test tube holders 21 in nearly a vertical posture. In each test tube 7, a desired amount of bio cells such as red blood cells are accumulated. By rotating the drive motor 4, the test tubes 7 are gradually oriented toward the horizontal direction. In this instance, when the pump 8 is actuated to introduce the cleaning liquid toward the nozzle 10, the cleaning liquid is ejected out of the nozzle 10 into cleaning liquid distributor 30 through the cleaning liquid inlet hole 32*a*. The cleaning liquid passes through the space defined between the upper and lower conical sections 32 and 37, and then urged radially outwardly because of the application of centrifugal force. The cleaning liquid are then distributed into respective distribution nozzles defined by the upper flat section 33 and twenty-four grooves 38*b* formed in the lower flat section 38. Thus, cleaning liquid is evenly ejected out of the distribution nozzle toward the test tubes 7. The cleaning liquid is impinged on an inner peripheral surface of the test tube 7, and moved toward a bottom of the test tube 7. This permits the bio cells deposited at the bottom portion of the test tube 7 to be floated to form a suspension state. After a predetermined amount of the cleaning liquid is accumulated in the test tube 7, the pump 23 is stopped to terminate a process of injection of the cleaning liquid.

Subsequently, rotation of the rotor 6 is continued until the floating bio cells are congregated onto the bottom of the test tube 7. Then, the rotation of the rotor 6 is stopped to restore the test tube holder 21 into their vertical orientation. In this case, because of the magnetically attractive force of the test tube holder attraction member 11, the test piece holders 21 are attracted to the test tube holder attraction member 11. In this state, the test tube 7 is directed substantially in a vertical direction, or the test tube 7 is directed such that its open end is slightly inclined radially outwardly as shown by a right side test tube 7 in FIG. 1.

Then, the drive motor 4 is rotated at a low speed while maintaining the electrically magnetic force of the attraction member 11, so that the test tubes 7 are moved along a circular locus while maintaining their substantially vertical orientations. Accordingly, the cleaning liquid accumulated in each test tube 7 is discharged out of the test tube because of the application of centrifugal force, while the bio cells deposited on the bottom of the test tube 7 remains in the test tube 7. Such cleaning process is repeatedly performed in order to remove foreign materials such as antibodies from the bio cells.

This cleaning process requires even amount of supply of the cleaning liquid to the respective test tubes 7 in order to enhance a resultant performance of the bio cell cleaning centrifuge 1. To this effect, high dimensional accuracy is required in the distribution nozzles defined by the upper flat section 33 and radial grooves 38*b* of the lower flat section 38. In the depicted embodiment, the upper and lower distribution segments 31 and 36 are manufactured by molding with resin. Therefore, a precise configuration of cleaning liquid distribution nozzles can be provided by molding the upper and lower flat sections 33 and 38 at high dimensional accuracy by using a metal mold with high dimensional accuracy. This is in high contrast to the conventional structure in which such flow passages or distribution nozzles are formed by drilling or provided by a metallic tube. Consequently, in the depicted embodiment, uniform flow resistance results with respect to the entire distribution nozzles and even amount of cleaning liquid can be delivered to the respective test tubes. Moreover, mass production of the upper and lower distribution segments 31 and 36 can be achieved at high reproducibility because of the utilization of the resin molding method.

A reagent such as antiglobulin can be dripped into the test tube 7 after the bio cell cleaning process. In this case, reaction between the bio cells such as red blood cells and the reagent can be promoted by manually oscillatingly rotating the bio cell cleaning rotor 6 in both forward and reverse direction. To this effect, the operator can manipulate the knob section 34. In this manipulation, the plurality of ribs 34A and the plurality of recesses 34*a* can facilitate the manipulation because of the reduction in slippage.

Further, when the cleaning liquid passes through the filter 50, foreign objects contained in the cleaning liquid can be trapped, and therefore, any clogging of the foreign materials at the distribution nozzles can be eliminated, and any decrease in supply of the cleaning liquid to the test tube 7 can be avoided.

Further, because the upper distribution segment 31 is made from the transparent or translucent material, the operator can visually observe the distribution nozzles, particularly the grooves 38*b* of the lower distribution segment 6, from outside of the upper distribution segment 31. Therefore, foreign material depositing or clogging position at the distribution nozzles can be found easily.

During pivotal motion of the test tubes 7 because of the application of the centrifugal force thereto, the radial projections 33A and 38A can reduce interfering length between the open end portion of the test tube 7 and the cleaning liquid distributor 30. As a result, a geometrical distance between the cleaning liquid distributor 30 and the test tube 7 can be reduced. Further, these radial projections 33A and 38A can reduce wind pressure applying to the flying cleaning liquid ejected out of the distribution nozzles, the wind pressure being applied when the rotor 6 is rotated. Thus, these radial projections can promote entry of the flying cleaning liquid into the test tubes. Moreover, the formation of the arcuate recesses 33*a* and 38*a* can decrease a mass of the resultant distributor 30, to lower the load applied to the drive motor 4.

Figure 7:
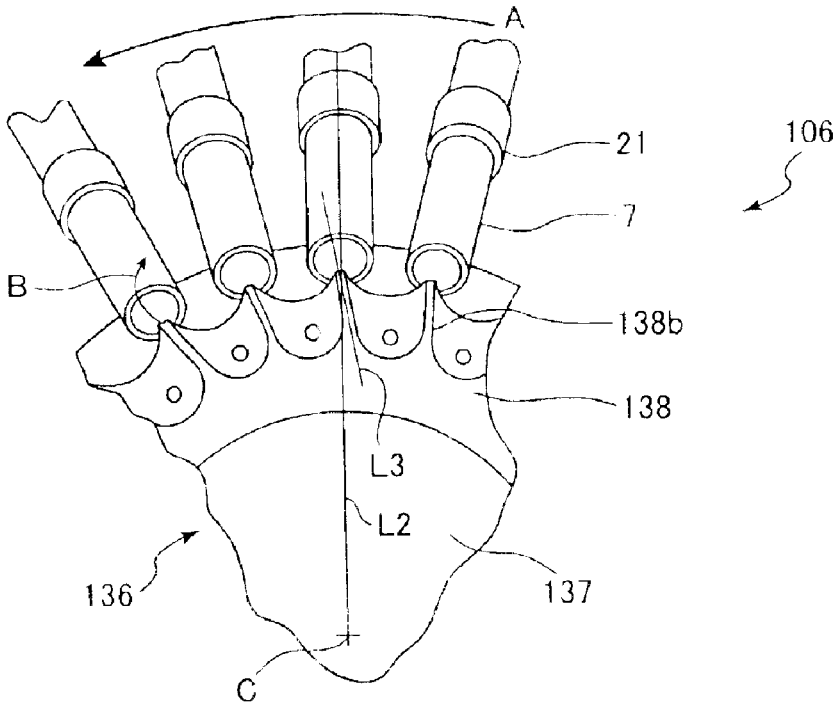
FIG. 7 is a plan view showing a part of a bio cell cleaning rotor, and particularly showing orientation of test tubes and grooves according to a modification to the first embodiment.

FIG. 7 shows a modification to the arrangement of lower flat section 138 of a lower distribution segment 136 in a bio cell cleaning rotor 106. Similar to the first embodiment, the lower flat section 138 includes a central conical section 137 and a radially outer side flat section 138, at which a plurality of grooves 138*b* are formed. In the third embodiment, each test tube 7 are directed toward a rotational center C as shown by the line L2. However, each grooves 138*b* is not directed toward a rotational center C, but are directed toward foreside in the rotating direction A as shown by a line L3. The line L3 intersects the line L2 at an radially outermost end of the groove 138*b*, i. e., at an outlet end of the distribution nozzle. More specifically, each center line L3 of each groove extends in a direction to intersect the radial line L2, so that a radially outer extension line from the groove is positioned ahead of the radial line L2 in the rotational direction A. With this arrangement, the test tube 7 can sufficiently receive the cleaning liquid elected along a curved flying locus as indicated by arrow B.

Figure 8:
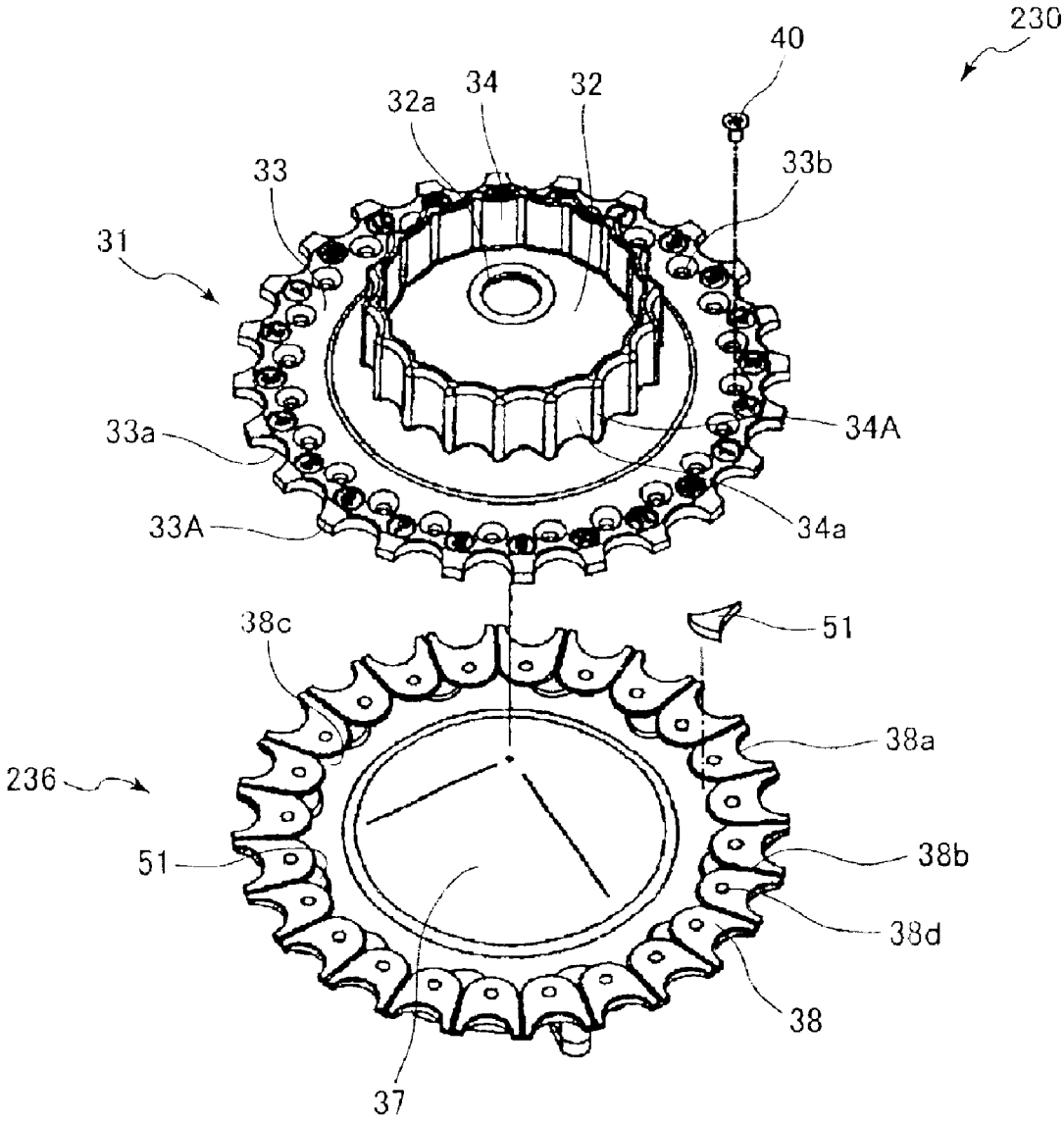
FIG. 8 is an exploded perspective view showing a cleaning liquid distributor according to a second embodiment of the present invention.

A cleaning liquid distributor according to a second embodiment of the present invention will be described with reference to FIG. 8, wherein like parts and components are designated by the same reference numerals and characters as those shown in FIGS. 1 through 7. According to the first embodiment, twenty-four test tubes 7 are held by twenty-four test tube holders 21. However, sometimes, bio cell cleaning is performed with respect to twelve test tubes 7. In the latter case, cleaning liquid is distributed to a place where the test tube 7 is not held by the test tube holder 21. This causes unwanted consumption of the cleaning liquid.

According to the second embodiment, a plurality of plug members 51 are provided (12 pieces in the embodiment) for plugging each inlet end (corresponding to a portion 38*c* in FIG. 5) of each cleaning liquid distribution nozzle. The plug member 51 is interposed between the upper and lower distribution segments 31 and 236, and has a symmetrical curved sides for intimate contact with each curved inlet end 38*c* for blocking each inlet end. Accordingly, cleaning liquid can only be ejected out of the distribution nozzles which are not plugged by the plug members 51. The plug members 51 are preferably made from an elastic material such as a silicone rubber to further promote contacting nature with the inlet end 38*c*. Because the upper distribution segment 31 is made from transparent or translucent materials, the operator can visually recognize the plug members 51 through the upper distribution segment 31. Thus, setting position of the test tubes 7 can be understood easily.

Figure 9:
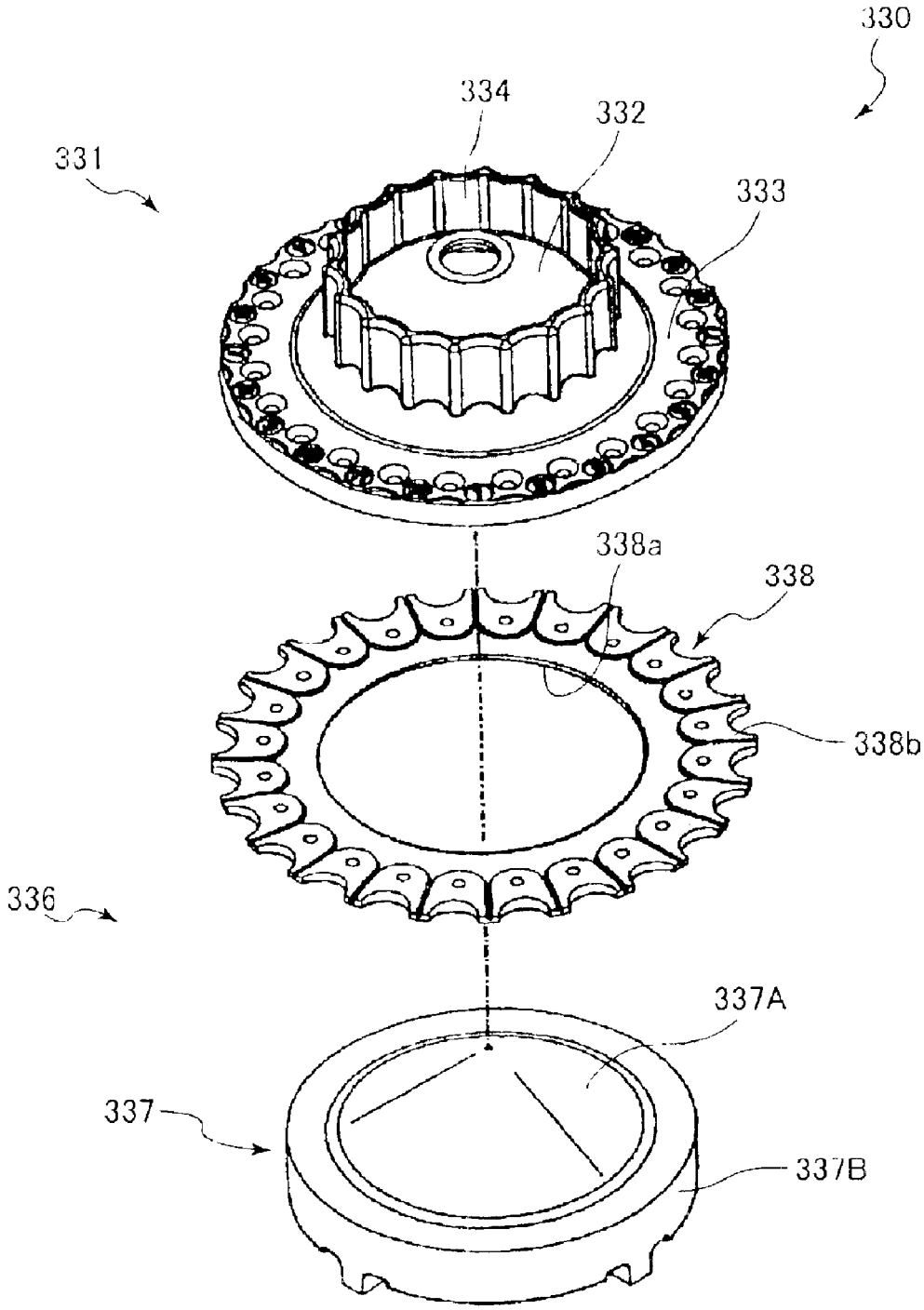
FIG. 9 is an exploded perspective view showing a cleaning liquid distributor according to a third embodiment of the present invention.
Figure 10:
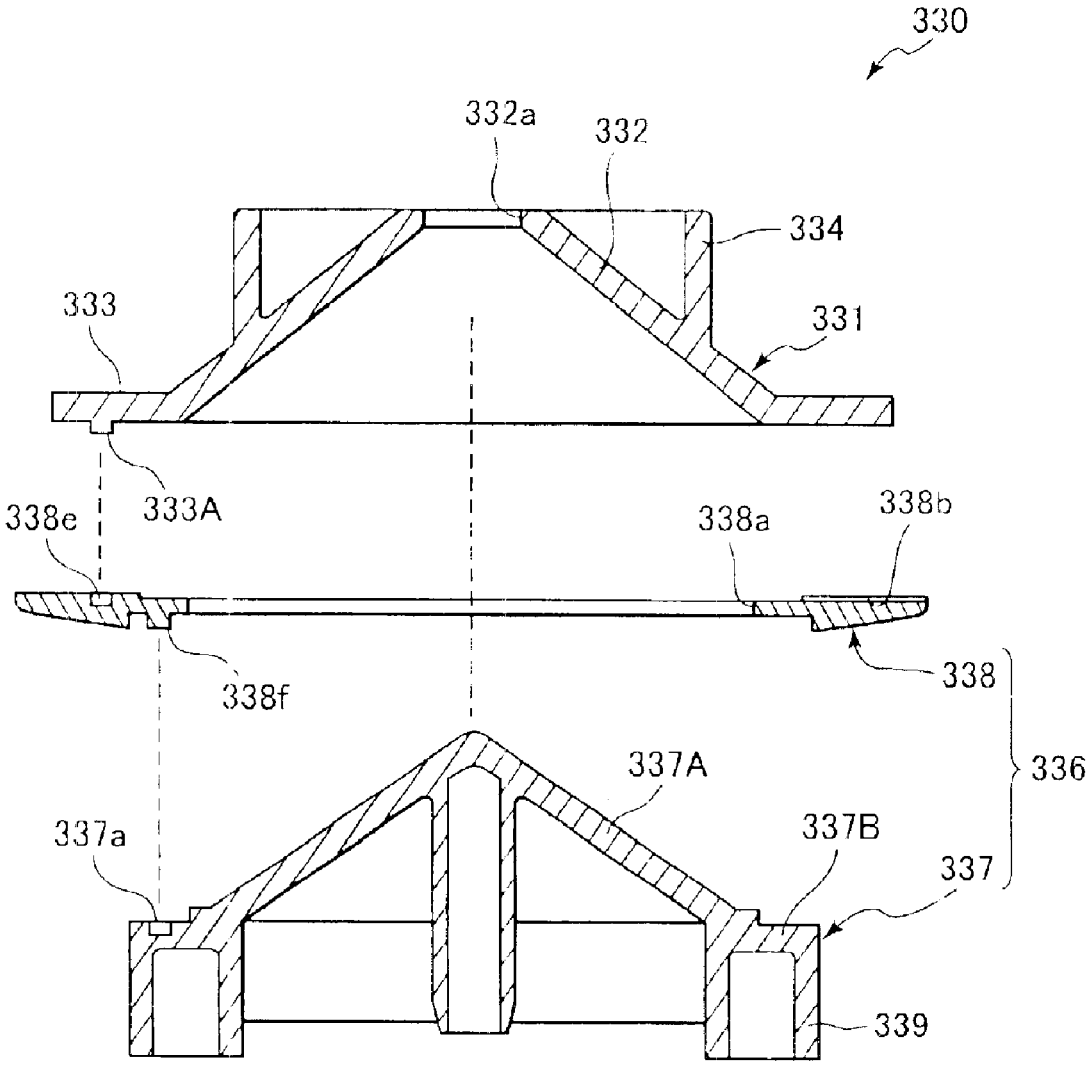
FIG. 10 is a cross-sectional view showing the cleaning liquid distributor according to the third embodiment.

FIGS. 9 and 10 show a cleaning liquid distributor 330 according to a third embodiment of the present invention. In the third embodiment, an upper distribution segment 331 including a conical section 332, a radially outer side flat section 333 and a knob section 334 is substantially identical with the upper distribution segment 31 of the foregoing embodiments except an engaging arrangement with a lower distribution segment 336. The lower distribution segment 336 is constituted by a ring like segment 338 and a base segment 337. The ring like segment 338 is formed with a central hole 338*a*, and has a radially outer portion formed with a plurality of radial grooves 338*b* serving as parts of cleaning liquid distribution nozzles.

The base segment 337 has a base section 337B on which the ring like segment 338 is detachably mounted. The base segment 337 also has a central conical section 337A projecting through the central hole 338*a* when the ring like segment 338 is mounted on the base segment 337. A combination of the ring like segment 338 and the base segment 337 corresponds to the cleaning liquid distributor 30 of the first embodiment. Various kind of ring like segments are prepared in which numbers of grooves 338*b* are different from one another. Numbers of the test tubes to be set on the test tube holders may be varied. Therefore, by selectively mounting one of the ring like segments onto the base segment 337 depending on the numbers of the test tubes, waste of cleaning liquid can be avoided.

FIG. 10 particularly shows an engaging arrangement in the distributor 330. The radially outer side flat section 333 of the upper distribution segment 331 has a positioning projection 333A, and the ring-like segment 338 has an upper surface formed with a complementary positioning recess 338*e*. A lower surface of the ring-like segment 338 has a positioning projection 338*f*, and the base section 337B of the base segment 337 is formed with a complementary recess 337*a*. Thus, these segments are assembled together without any mutual rotational displacement.

As best shown in FIG. 10, an outer diameter of the ring-like segment 338 is greater than those of the upper distribution segment 331 and the base segment 337, so that each outlet end of the radial grooves 338*b* can be positioned radially outwardly of other components. This arrangement can reduce a distance of interference between the test tube and the cleaning liquid distributor 330, and as a result, can reduce a distance between the test tube and the distributor 330. Moreover, curving tendency of the flying locus of the cleaning liquid ejecting out of the distribution nozzle due to wind pressure can be reduced for promoting entry of the cleaning liquid into the test tube. If the separate ring-like segment 338 is formed from an elastic material such as a silicone rubber, any destruction of the test tube can be prevented due to direct contact of the test tube with the ring-like segment 338. Alternatively, the elastic material is only applied to the radially outer end portion of the ring like segment 338.

While the invention has been described in detail and with reference to the specific embodiments thereof, it would be apparent to those skilled in the art that various changes and modifications may be made therein without departing from the spirit and scope of the invention.

For example, in the depicted embodiments, the distribution nozzles are provided by the upper flat section and the radial grooves formed at the lower flat section. However, distribution nozzles can also be provided by forming radial grooves at the upper flat section, or by forming radial grooves at both upper and lower flat sections.

Further, in the above described embodiments, the radial grooves are formed into liner shape. However, each radial groove can be formed into a curved shape.

Further, in the depicted embodiment, an entirety of the upper distribution segment is formed by the transparent or translucent material. However, only the flat section of the upper distribution segment can be formed by such material as long as observation to the fine parts such as portions around the grooves is required.

Further, the upper and lower distribution segments and can be formed by ceramic material instead of resin as far as these segments are produced by molding using a metal mold with high dimensional accuracy. However, in terms of productivity and evenness of flow resistance, the resin molded upper segment and the resin molded lower segment with the radial grooves as in the first embodiment is preferable.

Further, in the third embodiment, a porous filter 50 used in the first embodiment can be installed on the inlet opening 332*a* of the upper distribution segment 331. Moreover an entirety or a part of the upper distribution segment 331 can be formed from a transparent or translucent material similar to the foregoing embodiments.

What is claimed is:

1. A cleaning liquid distributor for use in a bio cell cleaning rotor, comprising:

an upper distribution segment having a disc like shape and having a first radially inner portion formed with a cleaning liquid inlet hole and a first radially outer portion formed into a first flat surface; and a lower distribution segment having a disc like shape and provided in opposition to the upper distribution segment, the lower distribution segment having a second radially inner portion in opposition to the first radially inner portion for forming a space therebetween and a second radially outer portion formed into a second flat surface in intimate contact with the first flat surface, at least one of the first flat surface and the second flat surfaces being formed with a plurality of grooves serving as cleaning liquid distribution nozzles each having a radially inner end in communication with the space and a radially outer end open to an atmosphere.

2. The cleaning liquid distributor as claimed in claim 1, wherein the upper distribution segment and the lower distribution segment are products of molding with one of a resin and ceramics.

3. The cleaning liquid distributor as claimed in claim 1, wherein the plurality of grooves extend in a completely radial direction of the upper and lower distribution segments, in which a each center line of each groove passes through a rotational center of the upper and lower distribution segments.

4. The cleaning liquid distributor as claimed in claim 1, wherein the upper and lower distribution segments are rotatable together in one direction, and wherein each of the plurality of grooves extends in a direction to intersect a radial line, so that each radially outer extension line from each groove is positioned ahead of the radial line in one direction.

5. The cleaning liquid distributor as claimed in claim 1, wherein the radially inner end of each groove is formed to have arcuate groove walls, whereby cleaning liquid in the space can be smoothly introduced into each groove.

6. The cleaning liquid distributor as claimed in claim 1, wherein at least the first radially outer portion of the upper distribution segment is made from one of a transparent material and a translucent material.

7. The cleaning liquid distributor as claimed in claim 1, wherein the first radially inner portion of the upper distribution segment comprises:

a conical section; and a cylindrical knob section protruding upwardly from the conical section, the knob having an outer peripheral surface provided with at least one of a plurality of projections extending in an axial direction of the knob section and a plurality of recesses extending in the axial direction of the knob section.

8. The cleaning liquid distributor as claimed in claim 1, wherein the first radially outer portion and the second radially outer portion are provided with a plurality of radially extending projections at positions corresponding to the plurality of grooves, so that each radially outer end of each grooves is positioned at a radially outermost position.

9. The cleaning liquid distributor as claimed in claim 1, further comprising a plurality of plug members detachably interposed between the upper distribution segment and the lower distribution segment and positioned at the radially inner ends of the grooves for preventing the cleaning liquid from entering into plugged grooves.

10. The cleaning liquid distributor as claimed in claim 9, wherein the plug members are formed of an elastic material.

11. The cleaning liquid distributor as claimed in claim 1, further comprising a filter provided detachably to the cleaning liquid inlet hole.

12. The cleaning liquid distributor as claimed in claim 1, wherein the lower distribution segment comprises:

a ring like segment serving as the second radially outer portion; and a base segment provided separate from the ring like segment and serving as the second radially inner portion and on which the ring like segment is detachably mounted.

13. The cleaning liquid distributor as claimed in claim 12, wherein the upper distribution segment, the ring like segment, and the base segments are one of resin molding products and ceramics molding product.

14. The cleaning liquid distributor as claimed in claim 12, wherein the first radially outer portion of the upper distribution segment and the ring like segment have mutually contacting portions formed with engagement protrusion and a complementary engagement recess, and the ring like segment and the base segment have mutually contacting portions formed with engagement protrusion and a complementary engagement recess.

15. The cleaning liquid distributor as claimed in claim 12, wherein the ring like segment has a radially outer end portion formed of an elastic or resilient material.

16. The cleaning liquid distributor as claimed in claim 12, wherein the ring like segment has an outer diameter greater than those of the upper distribution segment and the base segment.

17. A bio cell cleaning rotor for cleaning bio cells in test tubes with a cleaning liquid, comprising:

a rotor body rotatable about its axis;

a plurality of test tube holders pivotally movably supported to the rotor body, the test tubes held by the test tube holders being pivotally movable toward a horizontal direction upon application of centrifugal force thereto; and, a cleaning liquid distributor disposed above the rotor body and rotatable together with the rotor body, the cleaning liquid distributor comprising:

an upper distribution segment having a disc like shape and having a first radially inner portion formed with a cleaning liquid inlet hole and a first radially outer portion formed into a first flat surface; and a lower distribution segment having a disc like shape and provided in opposition to the upper distribution segment, the lower distribution segment having a second radially inner portion in opposition to the first radially inner portion for forming a space therebetween and a second radially outer portion formed into a second flat surface in intimate contact with the first flat surface, at least one of the first flat surface and the second flat surfaces being formed with a plurality of grooves serving as cleaning liquid distribution nozzles each having a radially inner end in communication with the space and a radially outer end open to an atmosphere.

18. The bio cell cleaning rotor as claimed in claim 17, wherein the upper distribution segment and the lower distribution segment are products of molding with one of a resin and ceramics.

19. The bio cell cleaning rotor as claimed in claim 17, wherein the plurality of grooves extend in a completely radial direction of the upper and lower distribution segments, in which a each center line of each groove passes through a rotational center of the upper and lower distribution segments, and wherein the plurality of test tube holders are pivotally movable on a vertical plane passing through the rotational center, the center lines being positioned forwardly of the plane in a rotational direction of the rotor body.

20. The bio cell cleaning rotor as claimed in claim 17, wherein the upper and lower distribution segments are rotatable together in one direction, and wherein the plurality of test tube holders are pivotally movable on a vertical plane passing through a rotational center of the rotor body; and wherein each of the plurality of grooves extends in a direction to intersect a radial line, so that each radially outer extension line from each groove is positioned ahead of the radial line in one direction.

21. The bio cell cleaning rotor as claimed in claim 17, wherein the radially inner end of each groove is formed to have arcuate groove walls, whereby cleaning liquid in the space can be smoothly introduced into each groove.

22. The bio cell cleaning rotor as claimed in claim 17, wherein at least the first radially outer portion of the upper distribution segment is made from one of a transparent material and a translucent material.

23. The bio cell cleaning rotor as claimed in claim 17, wherein the first radially inner portion of the upper distribution segment comprises:

a conical section; and a cylindrical knob section protruding upwardly from the conical section, the knob having an outer peripheral surface provided with at least one of a plurality of projections extending in an axial direction of the knob section and a plurality of recesses extending in the axial direction of the knob section.

24. The bio cell cleaning rotor as claimed in claim 17, wherein the first radially outer portion and the second radially outer portion are provided with a plurality of radially extending projections at positions corresponding to the plurality of grooves, so that each radially outer end of each grooves is positioned at a radially outermost position.

25. The bio cell cleaning rotor as claimed in claim 17, further comprising a plurality of plug members detachably interposed between the upper distribution segment and the lower distribution segment and positioned at the radially inner ends of the grooves for preventing the cleaning liquid from entering into plugged grooves.

26. The bio cell cleaning rotor as claimed in claim 25, wherein the plug members are formed of an elastic material.

27. The bio cell cleaning rotor as claimed in claim 17, further comprising a filter provided detachably to the cleaning liquid inlet hole.

28. The bio cell cleaning rotor as claimed in claim 17, wherein the lower distribution segment comprises:

a ring like segment serving as the second radially outer portion; and a base segment provided separate from the ring like segment and serving as the second radially inner portion and on which the ring like segment is detachably mounted.

29. The bio cell cleaning rotor as claimed in claim 28, wherein the upper distribution segment, the ring like segment, and the base segments are one of resin molding products and ceramics molding product.

30. The bio cell cleaning rotor as claimed in claim 28, wherein the first radially outer portion of the upper distribution segment and the ring like segment have mutually contacting portions formed with engagement protrusion and a complementary engagement recess, and the ring like segment and the base segment have mutually contacting portions formed with engagement protrusion and a complementary engagement recess.

31. The bio cell cleaning rotor as claimed in claim 28, wherein the ring like segment has a radially outer end portion formed of an elastic or resilient material.

32. The bio cell cleaning rotor as claimed in claim 28, wherein the ring like segment has an outer diameter greater than those of the upper distribution segment and the base segment.

33. A centrifuge for separating a first material from a second material in test tubes, removing the second material from the test tubes while applying a fluid into the test tubes, comprising:

a main body;

a drive mechanism supported on the main body and defining a rotation axis;

a rotor coupled to the drive mechanism and rotationally driven about the rotation axis by the drive mechanism, the rotor comprising:

a rotor body rotatable about its axis;

a plurality of test tube holders pivotally movably supported to the rotor body, the test tubes held by the test tube holders being pivotally movable toward a horizontal direction upon application of centrifugal force thereto; and, a fluid distributor disposed above the rotor body and rotatable together with the rotor body, the fluid distributor comprising:

an upper distribution segment having a disc like shape and having a first radially inner portion formed with a fluid inlet hole and a first radially outer portion formed into a first flat surface; and a lower distribution segment having a disc like shape and provided in opposition to the upper distribution segment, the lower distribution segment having a second radially inner portion in opposition to the first radially inner portion for forming a space therebetween and a second radially outer portion formed into a second flat surface in intimate contact with the first flat surface, at least one of the first flat surface and the second flat surfaces being formed with a plurality of grooves serving as fluid distribution nozzles each having a radially inner end in communication with the space and a radially outer end open to an atmosphere; and a fluid supplying mechanism provided to the main body for supplying a fluid to the fluid inlet hole of the upper distribution segment.

34. The centrifuge as claimed in claim 33, wherein the fluid comprises a cleaning liquid so that the centrifuge functions as a bio cell cleaning centrifuge.

35. The centrifuge as claimed in claim 33, wherein the upper distribution segment and the lower distribution segment are products of molding with one of a resin and ceramics.

36. The centrifuge as claimed in claim 33, wherein the plurality of grooves extend in a completely radial direction of the upper and lower distribution segments, in which a each center line of each groove passes through a rotational center of the upper and lower distribution segments, and wherein the plurality of test tube holders are pivotally movable on a vertical plane passing through the rotational center, the center lines being positioned forwardly of the plane in a rotational direction of the rotor body.

37. The centrifuge as claimed in claim 33, wherein the upper and lower distribution segments are rotatable together in one direction, and wherein the plurality of test tube holders are pivotally movable on a vertical plane passing through a rotational center of the rotor body; and wherein each of the plurality of grooves extends in a direction to intersect a radial line, so that each radially outer extension line from each groove is positioned ahead of the radial line in one direction.

38. The centrifuge as claimed in claim 33, wherein the radially inner end of each groove is formed to have arcuate groove walls, whereby cleaning liquid in the space can be smoothly introduced into each groove.

39. The centrifuge as claimed in claim 33, wherein at least the first radially outer portion of the upper distribution segment is made from one of a transparent material and a translucent material.

40. The centrifuge as claimed in claim 33, wherein the first radially inner portion of the upper distribution segment comprises:

a conical section; and a cylindrical knob section protruding upwardly from the conical section, the knob having an outer peripheral surface provided with at least one of a plurality of projections extending in an axial direction of the knob section and a plurality of recesses extending in the axial direction of the knob section.

41. The centrifuge as claimed in claim 33, wherein the first radially outer portion and the second radially outer portion are provided with a plurality of radially extending projections at positions corresponding to the plurality of grooves, so that each radially outer end of each grooves is positioned at a radially outermost position.

42. The centrifuge as claimed in claim 33, further comprising a plurality of plug members detachably interposed between the upper distribution segment and the lower distribution segment and positioned at the radially inner ends of the grooves for preventing the cleaning liquid from entering into plugged grooves.

43. The centrifuge as claimed in claim 42, wherein the plug members are formed of an elastic material.

44. The centrifuge as claimed in claim 33, further comprising a filter provided detachably to the cleaning liquid inlet hole.

45. The centrifuge as claimed in claim 33, wherein the lower distribution segment comprises:

a ring like segment serving as the second radially outer portion; and a base segment provided separate from the ring like segment and serving as the second radially inner portion and on which the ring like segment is detachably mounted.

46. The centrifuge as claimed in claim 45, wherein the upper distribution segment, the ring like segment, and the base segments are one of resin molding products and ceramics molding product.

47. The centrifuge as claimed in claim 45, wherein the first radially outer portion of the upper distribution segment and the ring like segment have mutually contacting portions formed with engagement protrusion and a complementary engagement recess, and the ring like segment and the base segment have mutually contacting portions formed with engagement protrusion and a complementary engagement recess.

48. The centrifuge as claimed in claim 45, wherein the ring like segment has a radially outer end portion formed of an elastic or resilient material.

49. The centrifuge as claimed in claim 45, wherein the ring like segment has an outer diameter greater than those of the upper distribution segment and the base segment.

* * * * *